US008573659B2

(12) United States Patent
Akizuki et al.

(10) Patent No.: US 8,573,659 B2
(45) Date of Patent: Nov. 5, 2013

(54) CHILD LOCK MECHANISM

(75) Inventors: Ryujiro Akizuki, Novi, MI (US); Takashi Nishio, Kariya (JP); Nobuko Watanabe, Anjo (JP); Yasuhiko Sono, Hekinan (JP); Kazunori Kojima, Aichi-gun (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 0 days.

(21) Appl. No.: 13/634,653

(22) PCT Filed: Mar. 3, 2011

(86) PCT No.: PCT/JP2011/054906

§ 371 (c)(1),
(2), (4) Date: Sep. 13, 2012

(87) PCT Pub. No.: WO2011/114898

PCT Pub. Date: Sep. 22, 2011

(65) Prior Publication Data

US 2013/0000363 A1 Jan. 3, 2013

(30) Foreign Application Priority Data

Mar. 15, 2010 (JP) ..... 2010-057504

(51) Int. Cl.
*E05C 3/06* (2006.01)

(52) U.S. Cl.
USPC ..... 292/216; 292/201; 292/DIG. 23

(58) Field of Classification Search
CPC ..... E05B 81/14; E05B 77/06
USPC ..... 292/201, 216, DIG. 23
See application file for complete search history.

(56) References Cited

U.S. PATENT DOCUMENTS 5,762,383 A 6/1998 Gomi
6,135,513 A 10/2000 Hamada et al.

(Continued)

FOREIGN PATENT DOCUMENTS

DE 19729188 A1 1/1998
GB 2332235 A 6/1999

(Continued)

OTHER PUBLICATIONS

International Search Report (PCT/ISA/210) issued on May 24, 2011, by the Japanese Patent Office as the International Searching Authority for International Application No. PCT/JP2011/054906.

(Continued)

*Primary Examiner* — Carlos Lugo
*Assistant Examiner* — Nathan Cumar
(74) *Attorney, Agent, or Firm* — Buchanan Ingersoll & Rooney PC

(57) ABSTRACT

Provided is a child lock mechanism which provides satisfactory operability at the time of operation of opening/closing a door while maintaining satisfactory operability at the time of setting/unsetting operation. The child lock mechanism includes: a base member; a first lever; a second lever; and an intermediate member assembled to the first lever and not assembled to the second lever. In a state in which the intermediate member is retained at an unset position, the intermediate member is rotatable relative to the base member, and a rotation center of the first lever relative to the base member and a rotation center of the intermediate member relative to the base member are arranged coaxially with each other.

3 Claims, 9 Drawing Sheets

(56) References Cited

U.S. PATENT DOCUMENTS

| | | | | |
|---|---|---|---|---|
| 6,343,817 | B1 | 2/2002 | Watanabe | |
| 2002/0089188 | A1 * | 7/2002 | Edgar | 292/216 |
| 2003/0094818 | A1 * | 5/2003 | Tomaszewski et al. | 292/195 |
| 2004/0262927 | A1 * | 12/2004 | Fukunaga et al. | 292/216 |
| 2006/0087129 | A1 * | 4/2006 | Gotou et al. | 292/216 |
| 2010/0171321 | A1 | 7/2010 | Akizuki et al. | |

FOREIGN PATENT DOCUMENTS

| | | | |
|---|---|---|---|
| JP | 2002-81247 | A | 3/2002 |
| JP | 2003 003714 | * | 1/2003 |
| JP | 2003-3714 | A | 1/2003 |
| JP | 2006-233456 | A | 9/2006 |
| JP | 2009-167594 | A | 7/2009 |

OTHER PUBLICATIONS

Written Opinion (PCT/ISA/237) issued on May 24, 2011, by the Japanese Patent Office as the International Searching Authority for International Application No. PCT/JP2011/054906.

European Supplemental Search Report dated Jun. 3, 2013 issued in the corresponding European Patent Application No. 11756087.0-1603.

* cited by examiner

CHILD LOCK MECHANISM

TECHNICAL FIELD

The present invention relates to a child lock mechanism of a vehicle door lock device.

BACKGROUND ART

As disclosed in, for example, Patent Document 1 below, a child lock mechanism of a vehicle door lock device includes: a base member adapted to be assembled to a door of a vehicle; a first lever rotatably assembled to the base member and adapted to be linked with a latch mechanism; a second lever rotatably assembled to the base member and adapted to interlock with an inside door handle; and an intermediate member arranged between the first lever and the second lever in a state in which the intermediate member is assembled to the first lever and is not assembled to the second lever, the intermediate member being allowed to be retained at an unset position or a set position. The child lock mechanism is structured in such a manner that, in a state in which the intermediate member is retained at the unset position, a movement of the second lever is transmittable to the first lever through the intermediation of the intermediate member, and in a state in which the intermediate member is retained at the set position, the movement of the second lever fails to strike the intermediate member and thus is untransmittable to the first lever.

PRIOR ART DOCUMENT

Patent Document

[Patent Document 1]: JP 2003-3714 A

In the above-mentioned child lock mechanism described in Patent Document 1, the intermediate member is arranged between the first lever and the second lever in the state in which the intermediate member is assembled to the first lever and is not assembled to the second lever. Accordingly, when the intermediate member is moved between the unset position and the set position, a movement affecting operability, such as a slip, is not generated between the intermediate member and the second lever, and hence it is possible to obtain satisfactory operability at the time of setting/unsetting operation.

SUMMARY OF THE INVENTION

Technical Problem

By the way, in the above-mentioned child lock mechanism described in Patent Document 1, a rotation center of the intermediate member relative to the base member when the intermediate member is retained at the unset position is separated by a predetermined amount from a rotation center of the first lever relative to the base member and a rotation center of the second lever relative to the base member. Thus, when the inside door handle is operated in the state in which the intermediate member is retained at the unset position, the movement (rotation) of the second lever is transmitted to the first lever through the intermediation of the intermediate member. However, a slip having a predetermined amount is generated in an engagement portion between the second lever and the intermediate member, and a slip having a predetermined amount is generated also in an engagement portion between the intermediate member and the first lever. Those slips may affect working property (operability) at the time of operation of opening/closing the door.

Solution to Problem

The present invention has been made to solve the above-mentioned problem (that is, to provide satisfactory operability at the time of operation of opening/closing a door while maintaining satisfactory operability at the time of setting/unsetting operation), and therefore provides a child lock mechanism, including: a base member adapted to be assembled to a door of a vehicle; a first lever rotatably assembled to the base member and adapted to be linked with a latch mechanism; a second lever rotatably assembled to the base member and adapted to interlock with an inside door handle; and an intermediate member arranged between the first lever and the second lever in a state in which the intermediate member is assembled to the first lever and is not assembled to the second lever, the intermediate member being allowed to be retained at an unset position or a set position, the child lock mechanism being structured in such a manner that, in a state in which the intermediate member is retained at the unset position, a movement of the second lever is transmittable to the first lever through intermediation of the intermediate member, and in a state in which the intermediate member is retained at the set position, the movement of the second lever fails to strike the intermediate member and thus is untransmittable to the first lever, in which, in the state in which the intermediate member is retained at the unset position, the intermediate member is rotatable relative to the base member, and a rotation center of the first lever relative to the base member and a rotation center of the intermediate member relative to the base member are arranged coaxially with each other.

In this case, the rotation center of the first lever relative to the base member may be set at a position different from a rotation center of the second lever relative to the base member, and a rotation locus, along which a region of the intermediate member engageable with the second lever is rotated relative to the base member when the intermediate member is retained at the unset position, and a rotation locus, along which a region of the second lever engageable with the intermediate member is rotated relative to the base member, may be set to be tangent to each other on a line connecting the rotation center of the first lever and the rotation center of the second lever. Alternatively, the rotation center of the first lever relative to the base member may be set to match with a rotation center of the second lever relative to the base member, and a rotation locus, along which a region of the intermediate member engageable with the second lever is rotated relative to the base member when the intermediate member is retained at the unset position, and a rotation locus, along which a region of the second lever engageable with the intermediate member is rotated relative to the base member, may be set to match with each other.

Further, the intermediate member may be movable between the unset position and the set position by a child protector lever which is rotatably assembled to the base member, the child protector lever being allowed to be manually operated from an indoor side of the door. In this case, the first lever may be rotatably assembled to the base member, and the intermediate member may be assembled to a rotation leading end portion of the first lever so as to be movable linearly, and may be coupled to a rotation leading end portion of the child protector lever through the intermediation of a coupling link. Alternatively, the first lever may be rotatably assembled to a rotation leading end portion of the child protector lever, and the intermediate member may be integrally assembled to a rotation leading end portion of the first lever.

Advantageous Effects of Invention

According to the child lock mechanism of the present invention, the intermediate member is arranged between the first lever and the second lever in the state in which the intermediate member is assembled to the first lever and is not assembled to the second lever. Accordingly, when the intermediate member is moved between the unset position and the set position, a movement affecting operability, such as a slip, is not generated between the intermediate member and the second lever, and hence it is possible to obtain satisfactory operability at the time of setting/unsetting operation.

Further, according to the child lock mechanism of the present invention, in the state in which the intermediate member is retained at the unset position (unset state), the intermediate member is rotatable relative to the base member, and the rotation center of the first lever relative to the base member and the rotation center of the intermediate member relative to the base member are arranged coaxially with each other. Thus, in the state in which the intermediate member is retained at the unset position, when the inside door handle is operated so that the movement of the second lever is transmitted to the first lever through the intermediation of the intermediate member, the region of the intermediate member engageable with the first lever is rotated along the same rotation locus as that of the region of the first lever engageable with the intermediate member. As a result, no slip is generated in an engagement portion between the intermediate member and the first lever. This can provide satisfactory working property at the time of operation of the inside door handle (operability at the time of operation of opening/closing the door).

Further, when carrying out the present invention described above, in the case where the rotation center of the first lever relative to the base member is set at the position different from the rotation center of the second lever relative to the base member, and the rotation locus, along which the region of the intermediate member engageable with the second lever is rotated relative to the base member when the intermediate member is retained at the unset position, and the rotation locus, along which the region of the second lever engageable with the intermediate member is rotated relative to the base member, are set to be tangent to each other on the line connecting the rotation center of the first lever and the rotation center of the second lever, as compared to a case where both the rotation loci are separated from each other or overlap each other on the connecting line, when operating the inside door handle in the unset state, it is possible to reduce a slip generated in an engagement portion between the second lever and the intermediate member. This can further improve working property at the time of operation of the inside door handle.

Further, when carrying out the present invention described above, in the case where the rotation center of the first lever relative to the base member is set to match with the rotation center of the second lever relative to the base member, and the rotation locus, along which the region of the intermediate member engageable with the second lever is rotated relative to the base member when the intermediate member is retained at the unset position, and the rotation locus, along which the region of the second lever engageable with the intermediate member is rotated relative to the base member, are set to match with each other, when operating the inside door handle in the unset state, it is possible to eliminate a slip generated in an engagement portion between the second lever and the intermediate member. This can further improve working property at the time of operation of the inside door handle.

MODE FOR CARRYING OUT THE INVENTION

Figure 1:
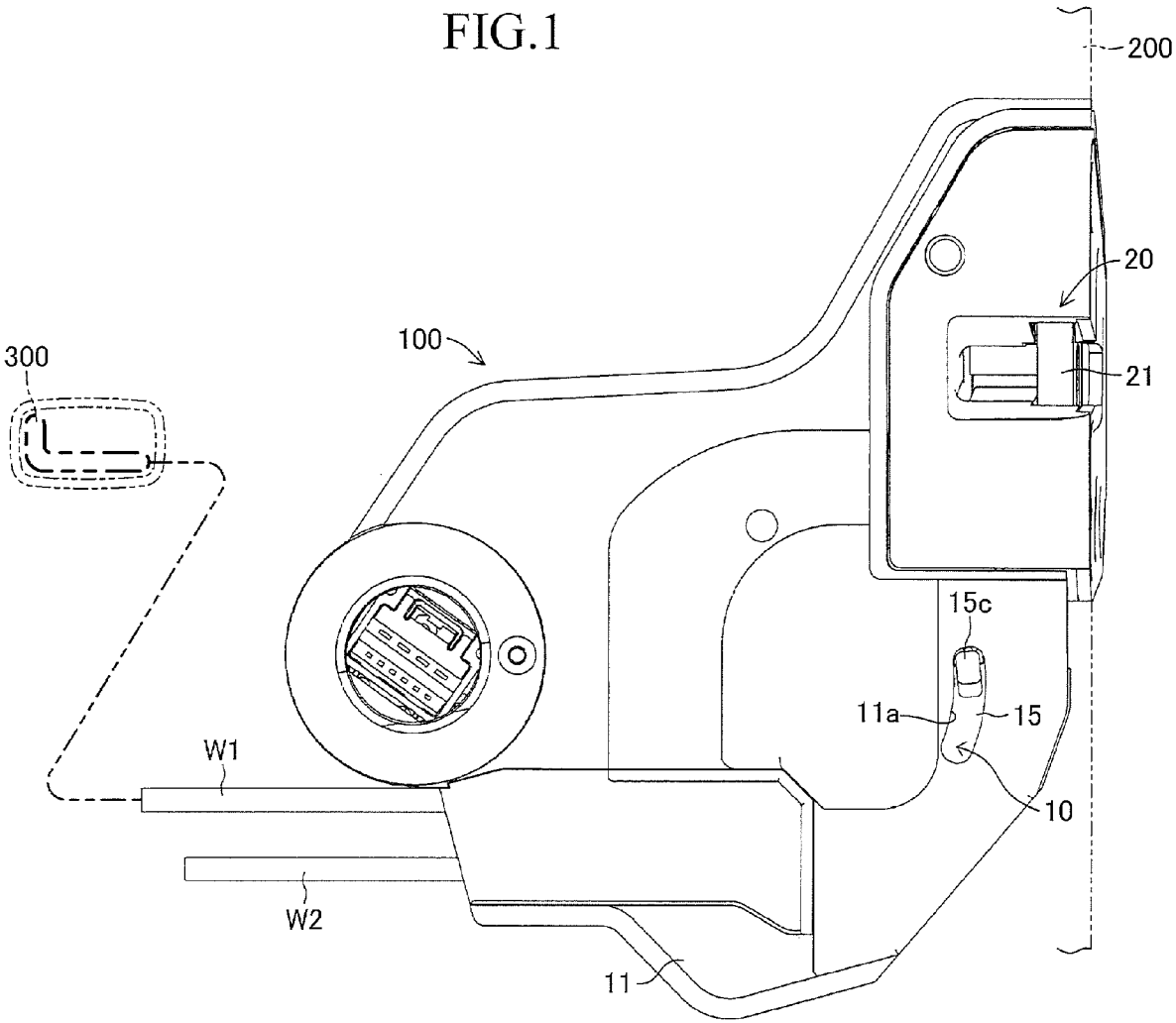
FIG. 1 is a side view seen from an inner side of a vehicle, which illustrates a vehicle door lock device provided with a child lock mechanism according to an embodiment of the present invention.

Hereinafter, embodiments of the present invention are described with reference to the drawings. FIGS. 1 to 6 illustrate a vehicle door lock device 100 provided with a child lock mechanism 10 according to an embodiment of the present invention. The vehicle door lock device 100 is installed in a door 200 (see a phantom line of FIG. 1) mounted on a rear right side of a vehicle, and includes, in addition to the child lock mechanism 10, a latch mechanism 20. Note that, as is well known, the latch mechanism 20 in a latch state keeps the door 200 closed with respect to a body (vehicle body (not shown)) (keeps a state in which the door 200 is closed), and the latch mechanism 20 in an unlatch state enables the door 200 to be opened with respect to the body. The latch mechanism 20 includes a latch 21 (see FIG. 1) which is engageable with and disengageable from a striker (not shown) fixed to the body. The latch mechanism 20 is assembled to the door 200 under a state in which the latch mechanism 20 is assembled to a housing 11.

The child lock mechanism 10 includes: the housing (base member) 11 adapted to be assembled to the door 200; a first inside open lever (first lever) 12 rotatably assembled to the housing 11 and adapted to be linked with the latch mechanism 20; a second inside open lever (second lever) 13 rotatably assembled to the housing 11 and adapted to interlock with an inside door handle 300 (see another phantom line of FIG. 1); and an intermediate member 14 arranged between the first inside open lever 12 and the second inside open lever 13 and allowed to be retained at an unset position or a set position. The child lock mechanism 10 further includes a child protector lever 15 and a coupling link 16.

Figure 4:
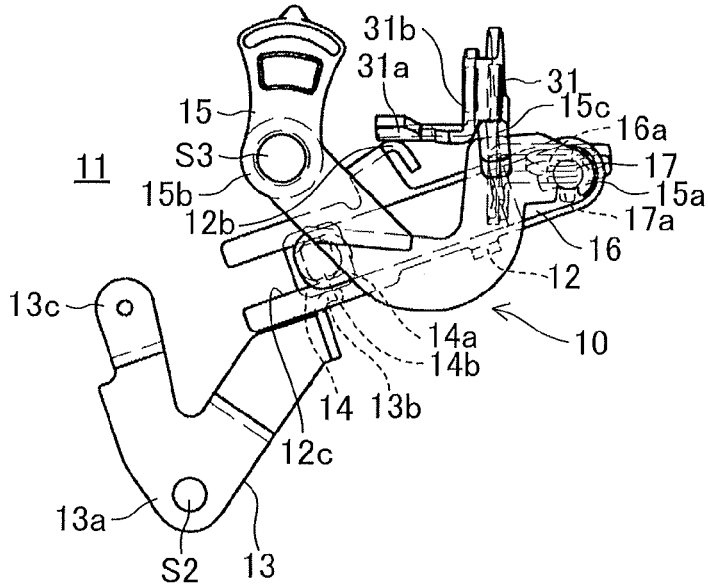
FIG. 4 is an explanatory diagram illustrating operation performed when a second inside open lever is rotated in the child lock mechanism illustrated in FIG. 3.
Figure 5:
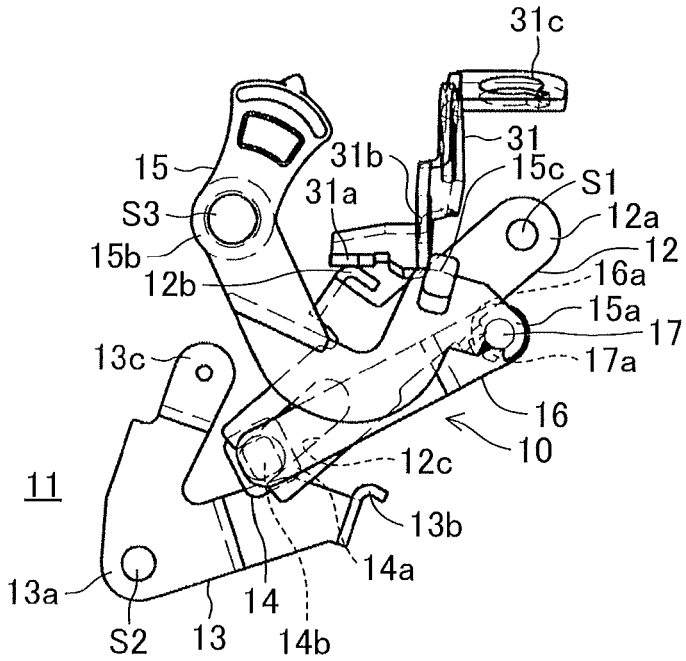
FIG. 5 is a side view illustrating a set state of the child lock mechanism illustrated in FIG. 2.
Figure 6:
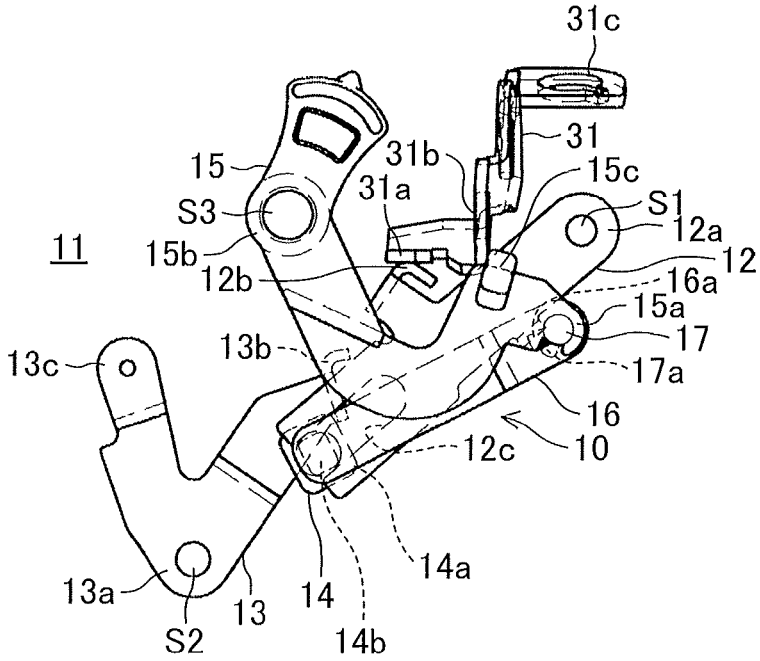
FIG. 6 is an explanatory diagram illustrating operation performed when the second inside open lever is rotated in the child lock mechanism illustrated in FIG. 5.
Figure 7:
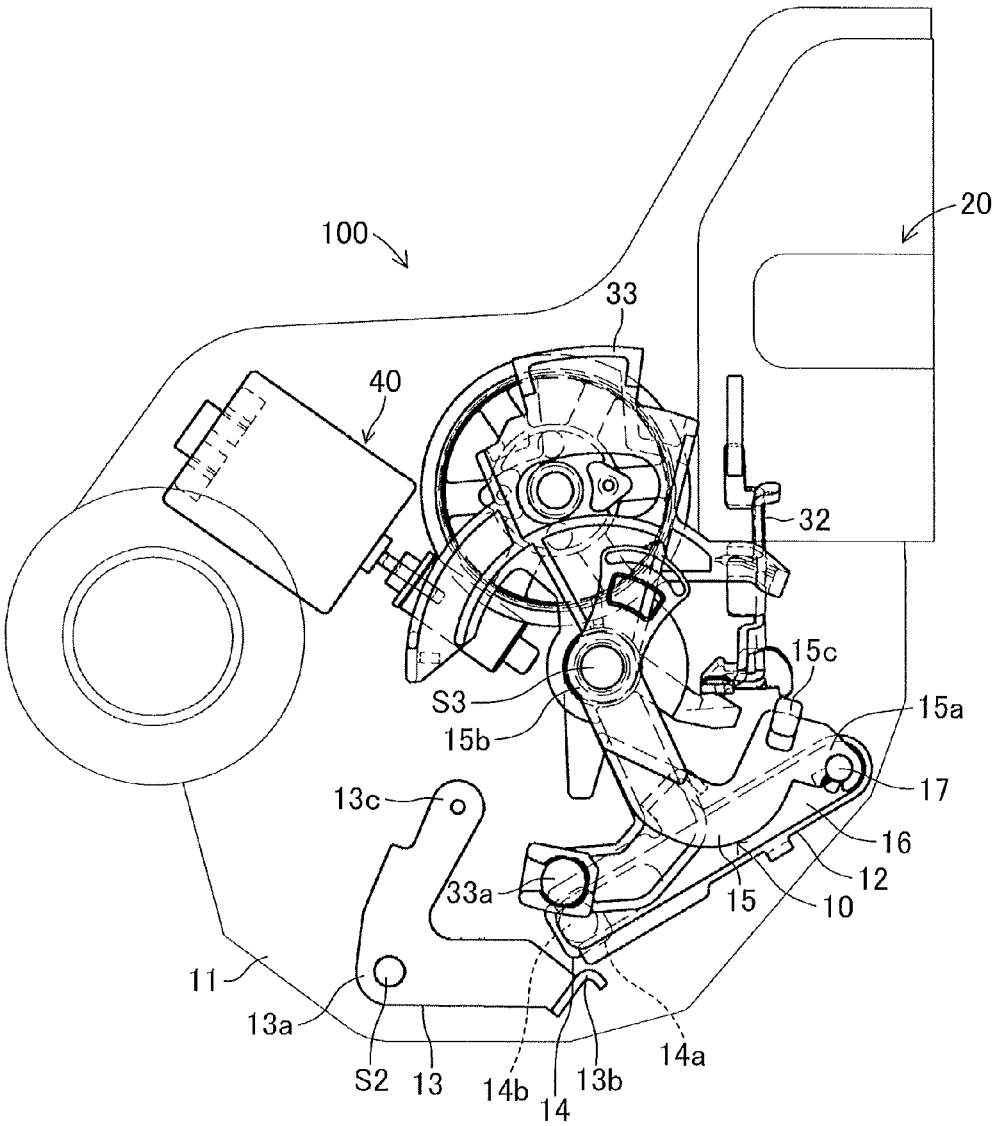
FIG. 7 is a side view corresponding to FIG. 2, which illustrates a modification of the child lock mechanism illustrated in FIGS. 1 to 6.
Figure 8:
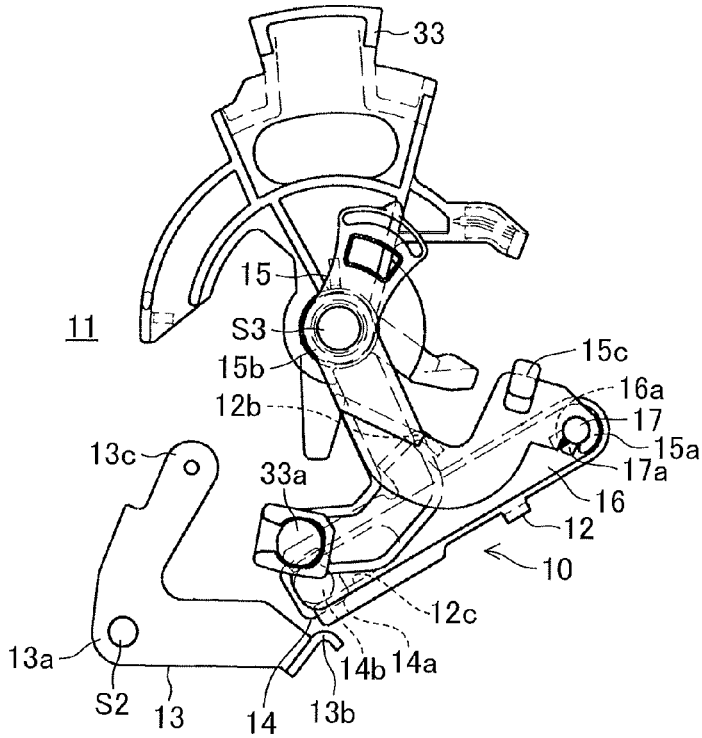
FIG. 8 is a side view illustrating an unset state of the child lock mechanism illustrated in FIG. 7.
Figure 9:
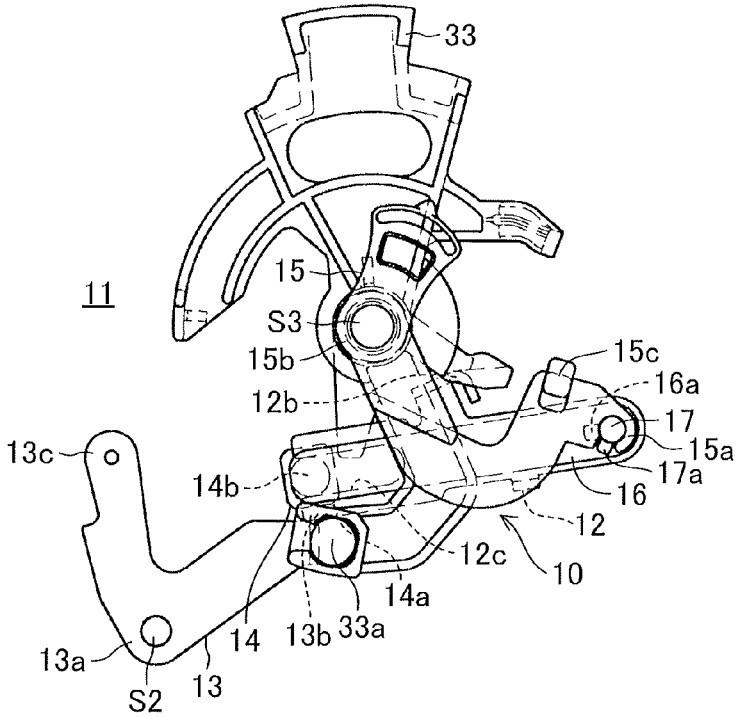
FIG. 9 is an explanatory diagram illustrating operation performed when the second inside open lever is rotated in the child lock mechanism illustrated in FIG. 8.
Figure 10:
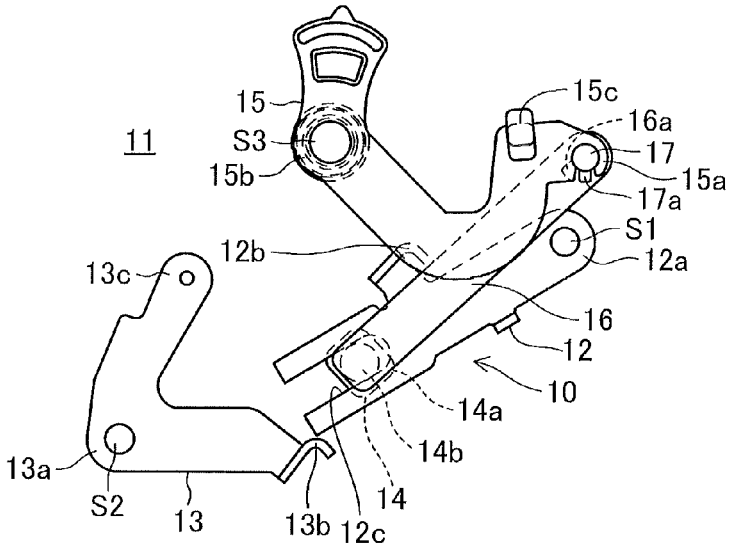
FIG. 10 is a side view illustrating a set state of the child lock mechanism illustrated in FIG. 7.
Figure 11:
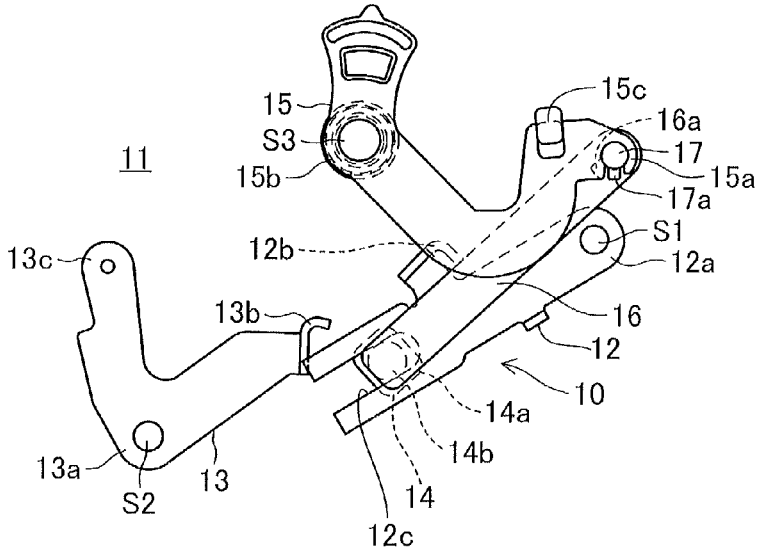
FIG. 11 is an explanatory diagram illustrating operation performed when the second inside open lever is rotated in the child lock mechanism illustrated in FIG. 10.

As illustrated in FIGS. 5 and 6, the first inside open lever 12 includes: one end portion 12*a* rotatably assembled to the housing 11 through the intermediation of a support shaft S1; an engagement portion 12*b* provided at an intermediate portion thereof so as to engage with an inside engagement portion 31*a* of an outside open lever 31; and a straight engagement groove 12*c* formed in the other end portion (rotation leading end portion) thereof. The first inside open lever 12 is linked at the engagement portion 12*b* through the intermediation of the outside open lever 31 and an open link 32 (see FIG. 2) with a pole (not shown) for restraining and permitting rotation of the latch 21. The first inside open lever 12 is rotated from a state illustrated in FIG. 3 to a state illustrated in FIG. 4, and thus can move the latch mechanism 20 from the latch state (state in which the pole restrains the rotation of the latch 21 to disable door opening operation) to the unlatch state (state in which the pole permits the rotation of the latch 21 to enable the door opening operation).

The second inside open lever 13 includes: a base end portion 13*a* rotatably assembled to the housing 11 through the intermediation of a support shaft S2; an engagement portion 13*b* formed at one end portion thereof so as to be engageable with a rectangular bush 14*a* of the intermediate member 14; and an operation arm portion 13*c* formed at another end portion thereof so as to be coupled through the intermediation of a coupling member (see an operation cable W1 of FIG. 1) to the inside door handle 300 provided on the inner side of the door 200. Through operating the inside door handle 300 to open the door, the second inside open lever 13 is rotated from the state illustrated in FIGS. 3 and 5 to the state illustrated in FIGS. 4 and 6.

The intermediate member 14 includes the rectangular bush 14*a* and a coupling shaft 14*b*. The intermediate member 14 is assembled to the first inside open lever 12, but is not assembled to the second inside open lever 13. Further, the intermediate member 14 is coupled to one end portion 15*a* of the child protector lever 15 through the intermediation of the coupling link 16 and a support pin 17. The coupling link 16 is rotatable about the support pin 17, and hence the intermediate member 14 is rotatable relative to the housing 11. The coupling shaft 14*b* is integrally coupled to the rectangular bush 14*a* at one end thereof, and is integrally coupled to the coupling link 16 at the other end thereof. The coupling shaft 14*b* is assembled to the first inside open lever 12 on an outer periphery of an intermediate portion (circular part) thereof so as to be slidable in the straight engagement groove 12*c* formed in the first inside open lever 12.

Figure 3:
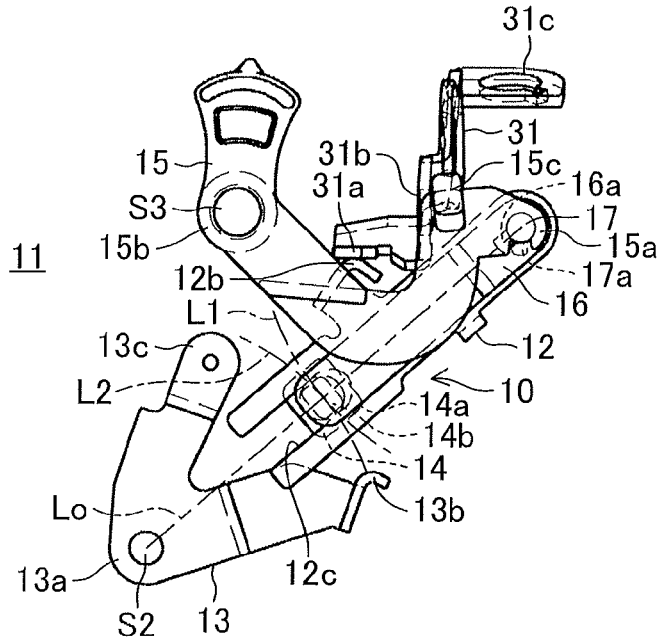
FIG. 3 is a side view illustrating an unset state of the child lock mechanism illustrated in FIG. 2.

The intermediate member 14 is retained at the unset position illustrated in FIG. 3 when the child protector lever 15 is retained at the unset position illustrated in FIG. 3, whereas the intermediate member 14 is retained at the set position illustrated in FIG. 5 when the child protector lever 15 is retained at the set position illustrated in FIG. 5. The intermediate member 14 can be moved by the child protector lever 15 between the unset position and the set position.

The child protector lever 15 is rotatably assembled to the housing 11 through the intermediation of a support shaft S3 at an intermediate portion 15*b* thereof, and is positioned and retained at the unset position illustrated in FIGS. 3 and 4 or the set position illustrated in FIGS. 5 and 6. Further, the child protector lever 15 includes an operation portion 15*c* which is formed in the vicinity of the one end portion 15*a* so as to protrude to the outside of the housing 11 through a circular-arc insertion hole 11*a* (see FIG. 1) of the housing 11. The child protector lever 15 can be manually operated by using the operation portion 15*c* from an indoor side of the door 200 only in a state in which the door 200 is opened.

The coupling link 16 is coupled to the coupling shaft 14*b* of the intermediate member 14 at one end portion (rotation leading end portion) thereof, and is rotatably coupled to the one end portion 15*a* of the child protector lever 15 through the intermediation of the support pin 17 at the other end portion (rotation center portion) thereof. The support pin 17 is unrotatably assembled to the one end portion 15*a* of the child protector lever 15, and supports the coupling link 16 so as to keep the coupling link 16 rotatable. Further, a protrusion 17*a* is integrally provided on the support pin 17. A protrusion 16*a* provided on the coupling link 16 engages with the protrusion 17*a*, and thus restrains the coupling link 16 from rotating about the support pin 17 in a counterclockwise direction of FIG. 3.

By the way, in the child lock mechanism 10 according to this embodiment, in a state in which the intermediate member 14 is retained at the unset position illustrated in FIG. 3, the intermediate member 14 is rotatable relative to the housing 11, and a rotation center of the first inside open lever 12 relative to the housing 11 (center of the support shaft S1) and a rotation center of the intermediate member 14 relative to the housing 11 (center of the support pin 17) are arranged coaxially with each other.

Further, in the child lock mechanism 10 according to this embodiment, as illustrated in FIG. 3, the rotation center of the first inside open lever 12 relative to the housing 11 (center of the support shaft S1 arranged coaxially with the center of the support pin 17) is set at a position different from a rotation center of the second inside open lever 13 relative to the housing 11 (center of the support shaft S2). A rotation locus L1, along which a region of the intermediate member 14 engageable with the second inside open lever 13 is rotated relative to the housing 11 when the intermediate member 14 is retained at the unset position, and a rotation locus L2, along which a region of the second inside open lever 13 engageable with the intermediate member 14 is rotated relative to the housing 11, are set to be tangent to each other on a line Lo connecting both the rotation center of the first inside open lever 12 and the rotation center of the second inside open lever 13.

Note that, in this embodiment, the outside open lever 31 is rotatably assembled to the housing 11 at an intermediate portion thereof. The outside open lever 31 includes, at an inner end portion thereof, the above-mentioned inside engagement portion 31*a* and a coupling portion 31*b* to be coupled to the open link 32, and includes, at an outer end portion thereof, an operation portion 31*c* to be coupled to an outside door handle (not shown) provided on the outer side of the door 200. The open link 32 (see FIG. 2) retained at an unlock position can be driven also through operating the outside door handle to open the door.

The open link 32 is interposed between the outside open lever 31 and a lift lever (not shown) provided to the latch mechanism 20. The open link 32 can be switched between the unlock position at which an action of the outside open lever 31 in a door opening direction is transmitted to the lift lever, and a lock position at which the action of the outside open lever 31 is not transmitted to the lift lever, the action of the outside open lever 31 being accompanied when each door handle is operated to open the door. Note that, the open link 23 is switched from the unlock position to the lock position and switched from the lock position to the unlock position through rotating an active lever 33.

Figure 2:
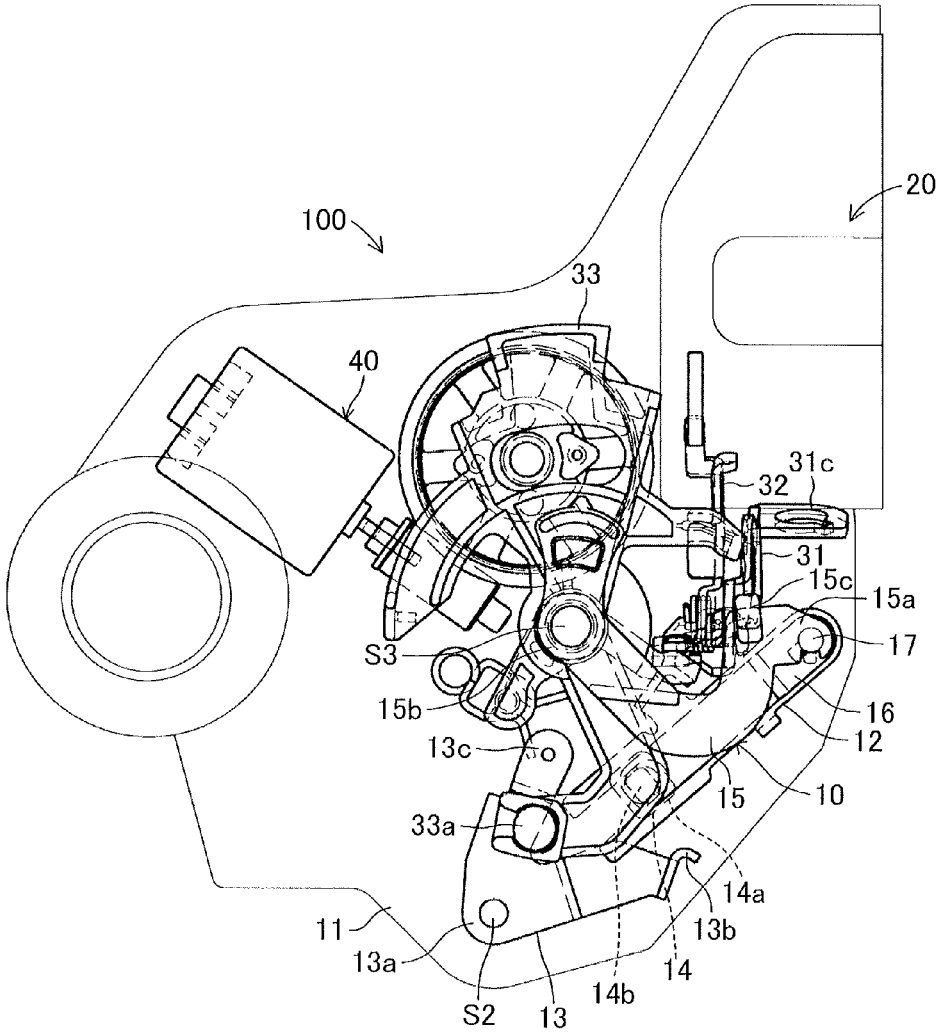
FIG. 2 is a side view illustrating relationships among main components of the vehicle door lock device illustrated in FIG. 1.

The active lever 33 can be rotated and driven by an action of an electric actuator 40 illustrated in FIG. 2 or by manual operation of a lock knob (not shown) provided on the inner side of the door 200. The active lever 33 is coupled to the lock knob (not shown) through the intermediation of a coupling member (see an operation cable W2 of FIG. 1) at an operation arm portion 33*a* thereof. Note that, a configuration of the electric actuator 40 has no connection with the present invention, and hence detailed description thereof is omitted.

In the child lock mechanism 10 according to this embodiment structured as described above, the intermediate member 14 is arranged between the first inside open lever 12 and the second inside open lever 13 in a state in which the intermediate member 14 is assembled to the first inside open lever 12 and is not assembled to the second inside open lever 13. Accordingly, when the intermediate member 14 is moved between the unset position and the set position, a movement affecting operability, such as a slip, is not generated between the intermediate member 14 and the second inside open lever 13, and hence it is possible to obtain satisfactory operability at the time of setting/unsetting operation performed through the child protector lever 15.

Further, in the child lock mechanism 10 according to this embodiment, the child protector lever 15 is rotatably assembled to the housing 11, the intermediate member 14 is rotatably assembled to the child protector lever 15 through the intermediation of the coupling link 16 and the support pin 17, and the intermediate member 14 is assembled so as to be rotatable relative to the housing 11. Further, in a state in which the child protector lever 15 is retained at the unset position (in the unset state illustrated in FIGS. 3 and 4), the rotation center of the first inside open lever 12 relative to the housing 11 (center of the support shaft S1) and the rotation center of the intermediate member 14 relative to the housing 11 (center of the support pin 17) are arranged coaxially with each other.

Accordingly, in a state in which the intermediate member 14 is retained at the unset position as illustrated in FIG. 3, when the inside door handle 300 is operated so that the movement of the second inside open lever 13 is transmitted to the first inside open lever 12 through the intermediation of the intermediate member 14 as illustrated in FIG. 4, the region of the intermediate member 14 engageable with the first inside open lever 12 is rotated along the same rotation locus as that of the region of the first inside open lever 12 engageable with the intermediate member 14. As a result, no slip is generated in an engagement portion between the intermediate member 14 and the first inside open lever 12.

Further, in the above-mentioned embodiment, the rotation center of the first inside open lever 12 relative to the housing 11 (center of the support shaft S1) is set at the position different from the rotation center of the second inside open lever 13 relative to the housing 11 material (center of the support shaft S2). In addition, the rotation locus (L1), along which the region of the intermediate member 14 engageable with the second inside open lever 13 is rotated relative to the housing 11 when the intermediate member 14 is retained at the unset position, and the rotation locus (L2), along which the region of the second inside open lever 13 engageable with the intermediate member 13 is rotated relative to the housing 11, are set to be tangent to each other on the line Lo connecting both the rotation center of the first inside open lever 12 and the rotation center of the second inside open lever 13 (see FIG. 3). Accordingly, as compared to a case where both the rotation loci (L1, L2) are separated from each other or overlap each other on the connecting line (Lo), when operating the inside door handle 300 in the unset state, it is possible to reduce a slip generated in an engagement portion between the second inside open lever 13 and the intermediate member 14. This can improve working property at the time of operation of the inside door handle 300.

In the above-mentioned embodiment, as illustrated in FIGS. 1 to 6, the present invention is carried out in such a manner that the intermediate member 14 retained at the unset position is moved downward along the engagement groove 12*c* of the first inside open lever 12, and thus moved to the set position. However, as in a modification illustrated in FIGS. 7 to 11, the present invention may be carried out in such a manner that the intermediate member 14 retained at the unset position is moved upward along the engagement groove 12*c* of the first inside open lever 12, and thus moved to the set position.

Further, in the above-mentioned embodiment, the present invention is carried out in such a manner that the first inside open lever 12 is rotatably assembled to the housing 11, the intermediate member 14 is assembled to the rotation leading end portion (engagement groove 12*c*) of the first inside open lever 12 so as to be movable linearly, and the intermediate member 14 is coupled to the rotation leading end portion (15*a*) of the child protector lever 15 through the intermediation of the coupling link 16 and the support pin 17. However, as in another embodiment illustrated in FIGS. 12 to 14, the present invention may be carried out in such a manner that a first inside open lever 112 is rotatably assembled to the rotation leading end portion (15*a*) of the child protector lever 15 through the intermediation of the support pin 17, and the intermediate member 14 is integrally assembled to a rotation leading end portion 112*c* of the first inside open lever 112.

Figure 12:
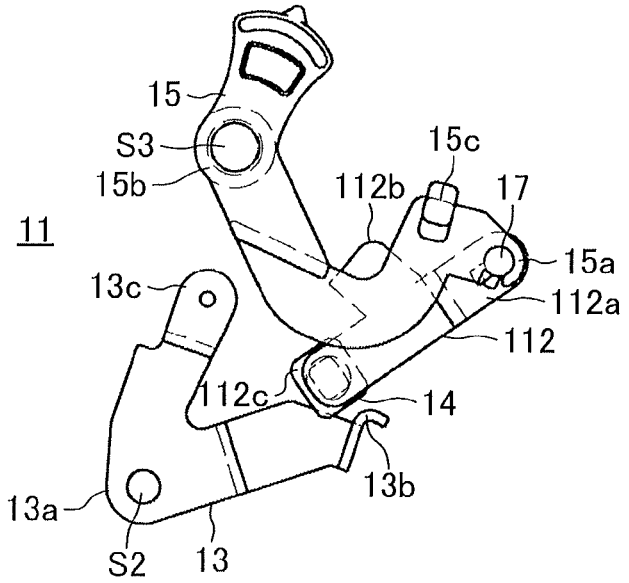
FIG. 12 is a side view corresponding to FIG. 3 (unset state), which illustrates a child lock mechanism according to another embodiment of the present invention.
Figure 13:
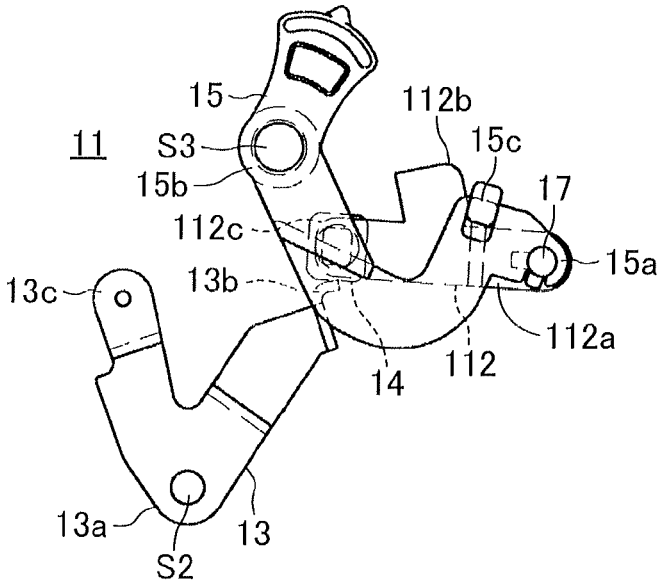
FIG. 13 is an explanatory diagram illustrating operation performed when the second inside open lever is rotated in the child lock mechanism illustrated in FIG. 12.
Figure 14:
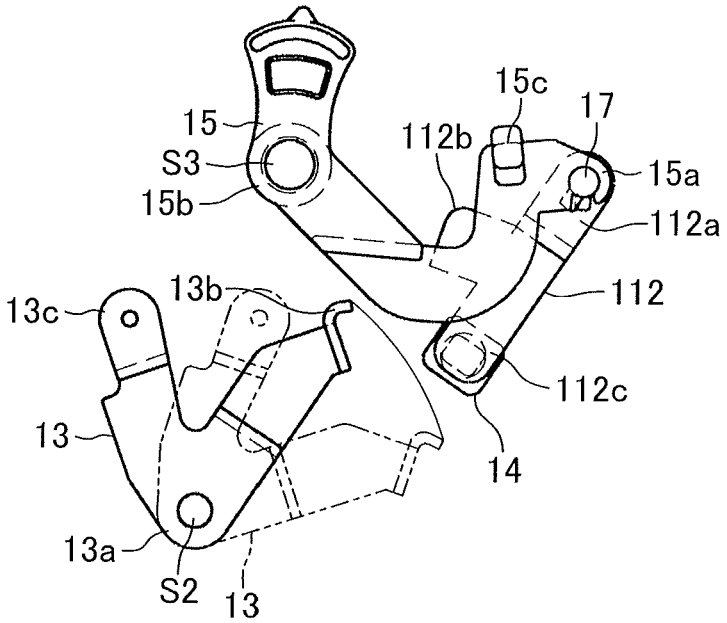
FIG. 14 is an explanatory diagram illustrating operation performed when the child lock mechanism illustrated in FIG. 12 is in a set state.

The embodiment illustrated in FIGS. 12 to 14 does not require members corresponding to the coupling link 16 and the support shaft S1 which are adopted in the embodiment illustrated in FIGS. 1 to 6 and the modification illustrated in FIGS. 7 to 11. Accordingly, the number of components of the child lock mechanism 10 can be reduced. In addition, it is not necessary to form the engagement groove (12*c*) in the first inside open lever 112. Thus, the child lock mechanism 10 can be structured simply at low cost.

Further, in each of the above-mentioned embodiments, the present invention is carried out in such a manner that the rotation center of the first inside open lever 12 relative to the housing 11 is set at the position different from the rotation center of the second inside open lever 13 relative to the housing 11, and that the rotation locus, along which the region of the intermediate member 14 engageable with the second inside open lever 13 is rotated relative to the housing 11 when the intermediate member 14 is retained at the unset position, and the rotation locus, along which the region of the second inside open lever 13 engageable with the intermediate member 14 is rotated relative to the housing 11, are set to be tangent to each other on the line connecting both the rotation center of the first inside open lever 12 and the rotation center of the second inside open lever 13. However, the present invention may be carried out in such a manner that the rotation center of the first inside open lever (12) relative to the housing (11) (support shaft S1) is set to match with the rotation center of the second inside open lever (13) relative to the housing (11) (support shaft S2), and that the rotation locus, along which the region of the intermediate member (14) engageable with the second inside open lever (13) is rotated relative to the housing (14) when the intermediate member (14) is retained at the unset position, and the rotation locus, along which the region of the second inside open lever (13) engageable with the intermediate member (14) is rotated relative to the housing (11), match with each other. In this case, when operating the inside door handle in the unset state, it is possible to eliminate a slip generated in the engagement portion between the second inside open lever (13) and the intermediate member (14), and hence it is possible to further improve working property at the time of operation of the inside door handle.

The invention claimed is:

1. A child lock mechanism, comprising:

a base member adapted to be assembled to a door of a vehicle;

a first lever rotatably assembled to the base member through an intermediation of a support shaft and adapted to be linked with a latch mechanism;

a second lever rotatably assembled to the base member and adapted to interlock with an inside door handle; and an intermediate member arranged between the first lever and the second lever in a state in which the intermediate member is assembled to the first lever and is not assembled to the second lever, the intermediate member being allowed to be retained at an unset position or a set position, the child lock mechanism being structured in such a manner that, in a state in which the intermediate member is retained at the unset position, a movement of the second lever is transmittable to the first lever through the intermediation of the intermediate member, and in a state in which the intermediate member is retained at the set position, the movement of the second lever fails to strike the intermediate member and thus is untransmittable to the first lever, wherein the intermediate member is movable between the unset position and the set position by a child protector lever which is rotatably assembled to the base member, the child protector lever being allowed to be manually operated from an indoor side of the door, wherein the intermediate member is assembled to an end portion of the first lever so as to be movable linearly with respect to the end portion of the first lever, and is coupled to an end portion of a coupling link, the coupling link being rotatably coupled to an end portion of the child protector lever through an intermediation of a support in at a rotation center portion of the coupling link, wherein, in the state in which the intermediate member is retained at the unset position, the support shaft and the support pin are arranged coaxially with each other.

2. A child lock mechanism according to claim 1, wherein a rotation center of the first lever relative to the base member is set at a position different from a rotation center of the second lever relative to the base member, and wherein a rotation locus, along which a region of the intermediate member engageable with the second lever is rotated relative to the base member when the intermediate member is retained at the unset position, and a rotation locus, along which a region of the second lever engageable with the intermediate member is rotated relative to the base member, are set to be tangent to each other on a line connecting the rotation center of the first lever and the rotation center of the second lever.

3. A child lock mechanism according to claim 1, wherein a rotation center of the first lever relative to the base member is set to match with a rotation center of the second lever relative to the base member, and wherein a rotation locus, along which a region of the intermediate member engageable with the second lever is rotated relative to the base member when the intermediate member is retained at the unset position, and a rotation locus, along which a region of the second lever engageable with the intermediate member is rotated relative to the base member, are set to match with each other.

* * * * *